US008632208B2

(12) United States Patent
Choong

(10) Patent No.: US 8,632,208 B2
(45) Date of Patent: Jan. 21, 2014

(54) METHODOLOGY OF PROVIDING WHITE LIGHTING WITH COLOUR COMBINATION

(75) Inventor: Weng Onn Choong, Perai (MY)

(73) Assignee: Itramas International, Inc., Selangor Darul Ehsan (MY)

( * ) Notice: Subject to any disclaimer, the term of this patent is extended or adjusted under 35 U.S.C. 154(b) by 284 days.

(21) Appl. No.: 12/266,741

(22) Filed: Nov. 7, 2008

(65) Prior Publication Data

US 2010/0118527 A1 May 13, 2010

(51) Int. Cl.
*F21S 10/00* (2006.01)

(52) U.S. Cl.
USPC ..... 362/231; 362/800; 362/84

(58) Field of Classification Search
USPC ..... 362/227, 231; 356/406, 416, 425, 420
See application file for complete search history.

(56) References Cited

U.S. PATENT DOCUMENTS

| | | | | |
|---|---|---|---|---|
| 5,821,867 | A | 10/1998 | Angell et al. | |
| 6,373,568 | B1 | 4/2002 | Miller et al. | |
| 6,411,046 | B1 * | 6/2002 | Muthu | 315/309 |
| 6,741,351 | B2 | 5/2004 | Marshall et al. | |
| 6,890,085 | B2 * | 5/2005 | Hacker | 362/231 |
| 7,312,430 | B2 | 12/2007 | Wong et al. | |
| 7,604,360 | B2 | 10/2009 | Chen et al. | |
| 7,619,192 | B2 | 11/2009 | Sun et al. | |
| 7,732,753 | B2 | 6/2010 | Greiner | |
| 2008/0013312 | A1 * | 1/2008 | Wu et al. | 362/231 |
| 2008/0112164 | A1 | 5/2008 | Teshirogi | |

FOREIGN PATENT DOCUMENTS

KR 723912 B1 * 5/2007 ..... H05B 37/02

OTHER PUBLICATIONS

The Office Action in co-pending U.S. Appl. No. 12/267,192, mailed Aug. 17, 2010, 10 pages.
U.S. Appl. No. 12/267,192, filed Nov. 7, 2008.
U.S. Appl. No. 12/267,135, filed Nov. 7, 2008.

* cited by examiner

*Primary Examiner* — Sharon Payne
(74) *Attorney, Agent, or Firm* — Preston Smirman; Smirman IP Law, PLLC

(57) ABSTRACT

The present invention relates generally to a methodology of creating lighting of white color with the intended correlated color temperature (CCT) by having a processing means to instruct several lighting means groups, wherein each group has different CCT ranges, that are arranged together, to provide lighting of a fixed CCT, wherein the lighting means groups comprises lighting means with dominant wavelength (DWL) range of 585 nm and 595 nm representing amber, CCT range of 2500K and 3700K representing warm white and CCT range of 3700K and 5000K representing white and CCT range of 5000K and 7000K representing cool white.

1 Claim, 1 Drawing Sheet

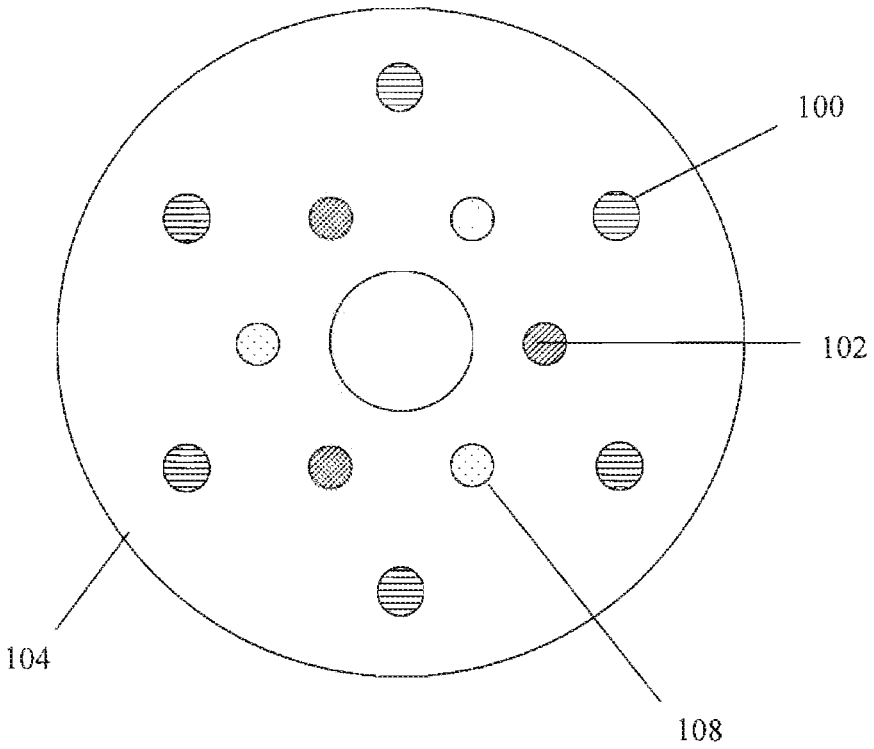
100
102
104
108

METHODOLOGY OF PROVIDING WHITE LIGHTING WITH COLOUR COMBINATION

TECHNICAL FIELD OF INVENTION

The present invention relates generally to a methodology of creating lighting of white colour with the intended correlated colour temperature (CCT) by having a processing means to instruct several lighting means groups, wherein each group has different CCT ranges, that are arranged together, to provide lighting of a fixed CCT, wherein the lighting means groups comprises lighting means with dominant wavelength (DWL) range of 585 nm and 595 nm representing amber, CCT range of 2500K and 3700K representing warm white, CCT range of 3700K and 5000K representing white and CCT range of 5000K and 7000K representing cool white.

BACKGROUND OF THE INVENTION

Colour temperature is a characteristic of visible light and usually determined by comparing its chromaticity with an ideal black-body radiator. The measurement for colour temperature is Kelvin (K). Examples of warm colours (with lower Kelvin value) are yellow and red while examples of cool colours (with higher Kelvin value) are blue and green. Warmer colour temperatures are suitable for living spaces while cooler colour temperatures are suitable for visual tasks. Recommended colour temperatures for general indoor and task lighting are in the 2580K-3710K range. (please follow Choong recommended)

CCT is the colour temperature of the black body radiator which has the closest matches to the light from the lamp to the human colour perception. This is because the lighting sources emit light primarily by mean of processes rather than increasing the temperature of the body.

Visible white light consists of electromagnetic radiation of various wavelengths. The colours are conventionally divided into red, orange, yellow, green, blue, indigo, and violet. Red, green and blue light are additive primary colours, which in combination will produce almost all colours, including white.

An impression of white light can be created by mixing appropriate intensities of primary colours of light (red, green and blue), a process called additive mixing as seen in many display technologies. Computer displays often have a colour temperature control, allowing user to select the colour temperature (usually from a small set of fixed values) of the light emitted when the computer produces the electrical signal corresponding to "white".

Solid state lighting that utilizes light emitting diodes as sources is replacing electrical filaments or gas because it creates visible light with reduced heat generation or parasitic energy dissipation and more resistance to shock and wear, therefore increasing the lifespan.

Light emitting diode (LED) lamp is a type of solid state lighting that comprises light emitting diodes as source of lighting instead of electrical filaments or gas. LED lamps usually contain clusters of LEDs in an appropriate housing. Due to the fact that LED can only produce one single colour, there are a few methods to convert it into white light. The first method is wavelength conversion, wherein LED colours are accompanied with phosphors of different colour. For example, blue LED with yellow phosphor, blue LED with several colours of phosphors, ultraviolet LED with red, green and blue phosphors, or blue LED with quantum dots.

The second method is colour mixing, wherein the usage of a plurality of LEDs with different colours, combined together in the correct proportion in order to produce white light. Several combinations can be done, such as two LEDs of blue and yellow colour; three LEDs of red, blue and green or four LEDs of red, blue, green and yellow. Since no phosphors are used for this method, there will be no energy loss in conversion process, resulting in higher efficiency. Although a colour mixing concept of single colour LEDs such as red, green, blue and yellow can be used to create white light, the brightness of each LED is limited compared to white LET. Therefore, using colour mixing of single colour LEDs will need extra energy or higher quantity in order to create the same luminous flux as white LEDs with different CCT ranges.

White LED is created by having a blue LED and a phosphor coating to mix yellow light with blue in order to produce light that appears to be white. Nevertheless, if white LED is used alone in the LED lamp, the colour temperature of the said LED lamp cannot be controlled because LED can degrade in time. Degradation happens especially to phosphor based LEDs due to the heat loss from the Stokes shift. Furthermore, the different phosphors used in white LEDs, which will degrade with heat and age, but at different rates will cause changes to the produced CCT of the light output. If a certain confined room contains several white LED lamps, which will degrade at different rates due to heat and age, there will be inconformity between the lamps, which may create undesirable CCT to the room given time. The usual solution to this problem would be to either change the white LED lamps or change the LED components in the lamp, which incurs extra cost and manpower.

Different CCT of white lighting is suitable for different usage in the space of lighting. For example, warmer colour temperature is suitable for living spaces while cooler colour temperature is suitable for visual tasks. Different user of lighting space will have different preference on the CCT of the white lighting. If the same space of lighting is used for different purposes and different users, there is a need to have an easy way to change the CCT of the white lighting source. Nevertheless, if a white LED lamp contains only white LEDs, the user will not be able to control the CCT of the lamp because white LEDs have fixed CCT, unless the user changes the hardware (ie white LEDs) in the lamp to produce different CCT.

The present invention overcomes, or at least partly alleviates the above shortcomings by providing a methodology of creating lighting of white colour with intended CCT, whereby the usage of any combination of cool white, white, warm white and amber LEDs with CCT ranges of 5000K and 7000K, 3700K and 5000K, 2500K and 3700K, and DWL ranges of 585 nm and 595 nm are used in the LED lamp; furtherance comprising a processing means in order to control the CCT of the lighting source depending on the preference and usage of the user.

SUMMARY OF THE INVENTION

Accordingly, it is the primary aim of the present invention to provide a methodology of creating lighting of white colour with the intended CCT to ease the user to control CCT of white lighting sources when the lighting source contains a plurality of cool white LEDs (not shown), white LEDs (108), warm white LEDs (102) and amber LEDs (100).

It is yet another object of the present invention to provide a methodology of creating lighting of white colour with intended CCT, wherein the user is able to control the CCT of the white lighting source according to the user's preference and usage without the need to replace the hardware.

It is yet another object of the present invention to provide a methodology of creating lighting of white colour with intended CCT, wherein the user is able to control the brightness of the white lighting source according to the user's preference and usage without the need to replace the hardware.

It is yet another object of the present invention to provide a methodology of creating lighting of white colour with intended CCT, wherein the optimum amount of lighting means groups and the amount of lighting means inside said lighting means groups is chosen to maintain a balance between cost of the LED lamp and the brightness of the LED lamp.

Other and further objects of the invention will become apparent with an understanding of the following detailed description of the invention or upon employment of the invention in practice.

According to a preferred embodiment of the present invention there is provided.

A methodology of creating lighting of white colour with the intended CCT, the steps comprising:

combining of plurality of lighting means groups with different CCT ranges;

having processing means to instruct said plurality of lighting means groups to provide lighting of a fixed CCT;

characterized in that said lighting means group comprises:

a plurality of lighting means with DWL range of 585 nm and 595 nm;

a plurality of lighting means with CCT range of 2500K and 3700K;

a plurality of lighting means with CCT range of 3700K and 5000K.

In another embodiment, the present invention provides,

A methodology of creating lighting of white colour with the intended CCT, the steps comprising:

combining of plurality of lighting means groups with different CCT ranges;

having processing means to instruct said plurality of lighting means groups to provide lighting of a fixed CCT, characterized in that said lighting means group comprises:

a plurality of lighting means with CCT range of 2500K and 3700K;

a plurality of lighting means with CCT range of 3700K and 5000K;

a plurality of lighting means with CCT range of 5000K and 7000K.

In another embodiment the present invention provides,

A methodology of creating lighting of white colour with the intended CCT, the steps comprising:

combining of plurality of lighting means groups with different CCT ranges in any combination;

having processing means to instruct said combination of plurality of lighting means groups to provide lighting of a fixed CCT;

characterized in that said lighting means group comprises:

a plurality of lighting means with DWL range of 585 nm and 595 nm a plurality of lighting means with CCT range of 2500K and 3700K;

a plurality of lighting means with CCT range of 3700K and 5000K;

a plurality of lighting means with CCT range of 5000K and 7000K;

BRIEF DESCRIPTION OF THE DRAWINGS

Other aspects of the present invention and their advantages will be discerned after studying the Detailed Description in conjunction with the accompanying drawings in which:

FIG. 1 is diagram showing the arrangement of the LED groups in the LED lamp.

DETAILED DESCRIPTION OF THE DRAWINGS

In the following detailed description, numerous specific details are set forth in order to provide a thorough understanding of the invention. However, it will be understood by those or ordinary skill in the art that the invention may be practiced without these specific details. In other instances well known methods, procedures and/or components have not been described in detail so as not to obscure the invention.

The invention will be more clearly understood from the following description of the preferred embodiments thereof, given by way of example only with reference to the accompanying drawings. In the descriptions that follow, like numerals represent like elements in all figures. For example, where the numeral (2) is used to refer to a particular element in one FIGURE, the numeral (2) appearing in any other FIGURE refers to the same element.

Description of one or more embodiments of the invention is provided as follows along with diagrams that illustrate the principles and application of the invention. The invention is described in connection with such embodiments, but invention is not limited to any embodiment. The scope of the invention is limited only by the claims and the invention encompasses numerous alternatives, modifications and equivalents. Numerous specific details are set forth in the following description in order to assist in creating a thorough understanding of the invention. These details are provided for the purpose of example and the invention may be practiced according to the claims without some or all of these specific details.

Referring now to FIG. 1, there is shown the arrangement of the LED groups in the LED lamp. There are three groups of LED, wherein each group comprises a plurality of LEDs with a certain range of CCT. These three groups of LED can be any combination of four main groups of LED. The first group of LEDs comprises amber LEDs (100) with DWL range of 585 nm to 595 nm. The second group of LEDs comprises warm-white LEDs (102) with CCT range of 2500K to 3700K. The third group of LEDs comprises white LEDs (108) with CCT range of 3700K to 5000K. The fourth group of LEDs comprises cool white LEDs (not shown) with CCT range of 5000K to 7000K. The quantity of LEDs in the LED lamp can be varied in order to achieve the total white light output with the COST range of 2500K to 5000K. The arrangement of the LED groups can be varied too in order to achieve the desired CCT. The LEDs are arranged on an LED plate (104) which holds all the LEDs in the LED lamp in this embodiment, three groups of LED are chosen in order to maintain a balance between the cost of the LED lamp and the brightness of the LED lamp. The perceived brightness or power of light is called luminous flux. If only two groups of LED are chosen, the LED lamp will not be able to emit the brightness that is essential to light up the intended space. Recommended colour temperatures for general indoor and task lighting are in the 2700K to 3600K range. Each type of LED has different luminous flux. Amber LED (100) has luminous flux of 35 lm, warm white LED (102) has luminous flux of 70 lm and white LED (108) has luminous flux of 80 lm. If only two groups of LEDs are used, for example six amber LEDs (100) and three warm white LEDs (102), then the total luminous flux would be 420 lm, which is very low for general indoor and task lighting. Another way to increase the luminous flux using only two groups of LED is to increase the quantity of LEDs, but this will incur more cost to the LED lamp.

A processing means is included to the LED lamp to control the usage of the LED groups in order to obtain the desired total CCT for the LED lamp. Said processing means will refer to a certain database in order to determine the pulse width modulation (PWM) for each LED group to operate in order to achieve the desired CCT of the LED lamp.

It will be understood by those skilled in the art that changes and modifications may be made to the invention without departing from the spirit and scope of the invention.

Therefore it is intended that the foregoing description is merely for illustrative purposes and not intended to limit the spirit and scope of the invention in any way but only by the spirit and scope of the appended claim.

What is claimed is:

1. A methodology for creating lighting of white color with an intended correlated color temperature (CCT), comprising the steps of:

providing a lamp system, wherein the lamp system includes a lighting system;

wherein the lighting system comprises four lighting means groups, wherein the four lighting means groups comprise:

a first lighting means group comprising a plurality of amber light-emitting diodes (LED) with a dominant wavelength in the range of 585 nm to 595 nm;

a second lighting means group comprising a plurality of phosphor-based warm white LED having a CCT in the range of 2500K to 3700K;

a third lighting means group comprising a plurality of phosphor-based white LED having a CCT in the range of 3700K to 5000K;

a fourth lighting means group comprising a plurality of phosphor-based cool white LED having a CCT in the range of 5000K to 7000K; and providing a processing means selectively operable to instruct the lighting system to change the lighting to the intended CCT;

wherein the processing means is selectively operable to vary a brightness level of lighting system;

wherein the processing means is selectively operable to select a combination of the first lighting means group and only two of the second through fourth lighting means groups to provide lighting of a fixed CCT.

* * * * *